US007275770B2

(12) United States Patent
Guebre-Tsadik et al.

(10) Patent No.: US 7,275,770 B2
(45) Date of Patent: Oct. 2, 2007

(54) INTERLOCK SYSTEM FOR ENCLOSURES

(75) Inventors: Anteneh Guebre-Tsadik, Blaine, MN (US); Robert Martin Kalstabakken, Brook Park, MN (US); Joseph David Ricke, Arden Hills, MN (US); Dean Jerome Bergerson, Brooklyn Park, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 0 days.

(21) Appl. No.: 11/055,538

(22) Filed: Feb. 8, 2005

(65) Prior Publication Data

US 2006/0175839 A1 Aug. 10, 2006

(51) Int. Cl.
*E05C 1/04* (2006.01)

(52) U.S. Cl. ..... 292/145; 292/302; 49/366; 49/394

(58) Field of Classification Search ..... 16/145, 16/170, 302 X, 304, 341.15, DIG. 12, DIG. 17, 16/DIG. 21; 312/322, 326, 329; 49/366 X, 49/394 X; 292/145, 170, 302 X, 304, 341.15, 292/DIG. 12, DIG. 17, DIG. 21, 137, 163, 292/159, 175, 171, 150, 302
See application file for complete search history.

(56) References Cited

U.S. PATENT DOCUMENTS 551,490 A * 12/1895 Hogaboom ..... 292/136
1,265,351 A * 5/1918 Menier ..... 292/341.11
1,340,398 A * 5/1920 O'Brien ..... 292/335
3,583,736 A * 6/1971 Willimzik ..... 292/16
3,822,506 A * 7/1974 Fishbach ..... 49/367
4,120,550 A * 10/1978 Sherburn ..... 312/296
4,159,153 A * 6/1979 Yoshikawa ..... 312/333
4,265,058 A * 5/1981 Logsdon ..... 52/58
4,451,072 A * 5/1984 Petty, Sr. ..... 292/128
5,064,229 A * 11/1991 Hamada et al. ..... 292/216
5,452,544 A * 9/1995 Weathington, Sr ..... 49/394
5,782,507 A * 7/1998 Hardee ..... 292/267
5,944,397 A 8/1999 Zeitler
6,047,501 A * 4/2000 Zeitler ..... 49/506
6,250,015 B1 * 6/2001 Gillispie ..... 49/367
6,802,579 B2 * 10/2004 Huw-Ching et al. ..... 312/332.1
6,871,451 B2 * 3/2005 Harger et al. ..... 49/449
6,971,686 B2 * 12/2005 Becken ..... 292/39
2004/0189021 A1 * 9/2004 Eckerdt ..... 292/341.15
2006/0006773 A1 * 1/2006 Guebre-Tsadik et al. ... 312/326

* cited by examiner

*Primary Examiner*—Brian E. Glessner
*Assistant Examiner*—Mark A. Williams
(74) *Attorney, Agent, or Firm*—Schwegman, Lundberg & Woessner, P.A.

(57) ABSTRACT

An apparatus to interlock a multi-door enclosure includes an actuating member slidably mountable to the enclosure between a primary door and a secondary door. The actuating member includes a first end extendable through an opening in a door post between the primary door and the secondary door. The apparatus includes a latching member slidably mounted to the actuating member and extending over a second end of the actuating member to engage a portion of the secondary door.

11 Claims, 5 Drawing Sheets

INTERLOCK SYSTEM FOR ENCLOSURES

FIELD OF THE INVENTION

This invention relates to the field of electrical enclosures, and more specifically to a method and apparatus for interlocking the doors of an enclosure.

BACKGROUND

Electrical enclosures can be used to house assorted electrical equipment. The enclosure protects the electrical equipment from the environment and helps prevent access to the equipment. Multi-door enclosures are enclosures with more than one door. Multi-door enclosures include a primary or master door and one or more secondary or slave doors. In some applications, industry standards require that the secondary doors be unopenable unless the primary door is opened. To perform such a function, some multi-door enclosures include relatively complex and large mechanisms which disable the door handle latch mechanism of the secondary door when the primary door is closed and enable the handle latch mechanism of the secondary door when the primary door is open. A less complex system is needed for multi-door enclosures.

SUMMARY

In one aspect an apparatus to interlock a multi-door enclosure includes an actuating member slidably mountable to the enclosure between a primary door and a secondary door. The actuating member includes a first end extendable through an opening in a door post between the primary door and the secondary door. The apparatus includes a latching member slidably mounted to the actuating member and extending over a second end of the actuating member to engage a portion of the secondary door.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
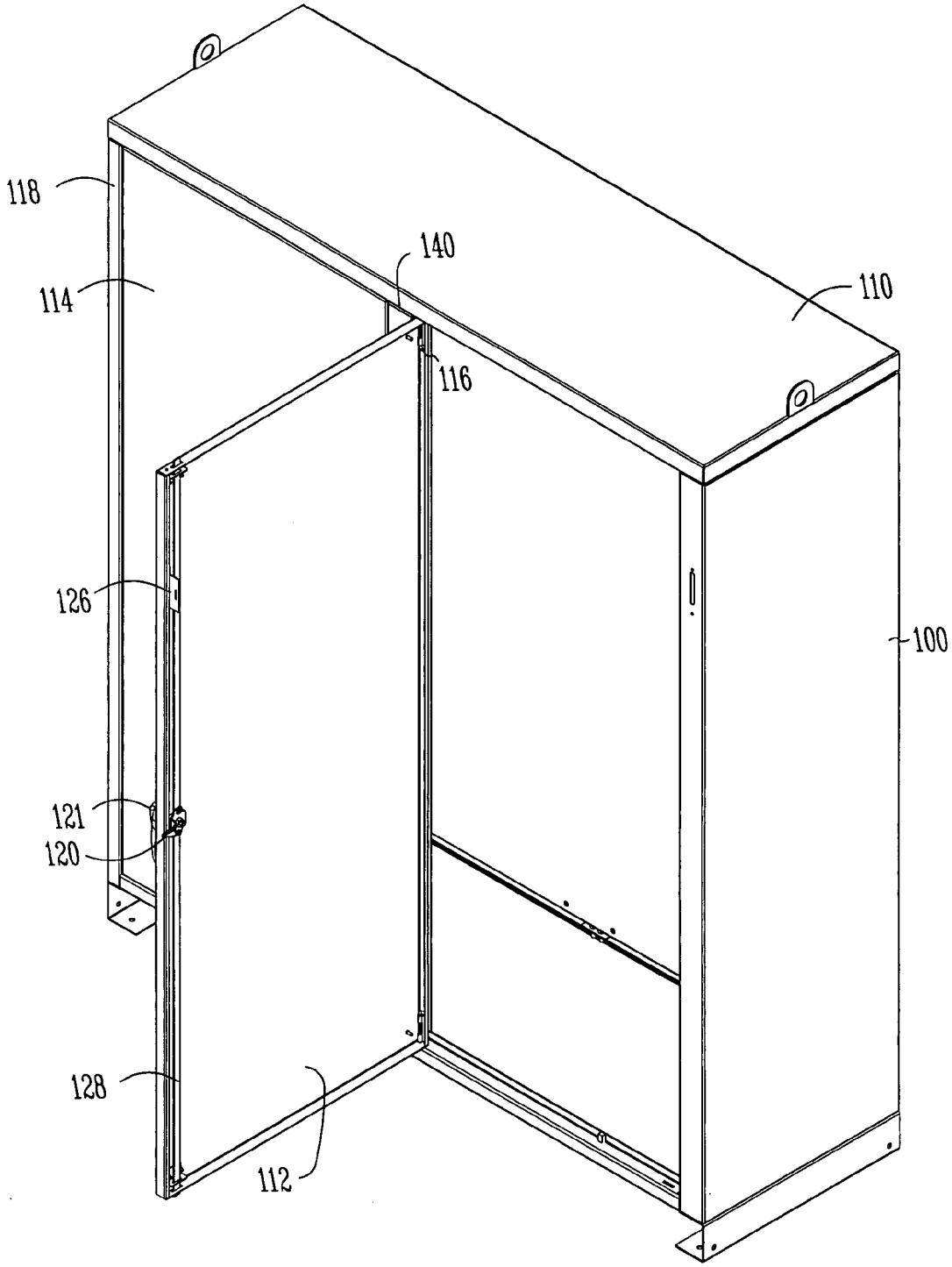
FIG. 1 shows a perspective view of a multi-door enclosure according to one embodiment.
Figure 2:
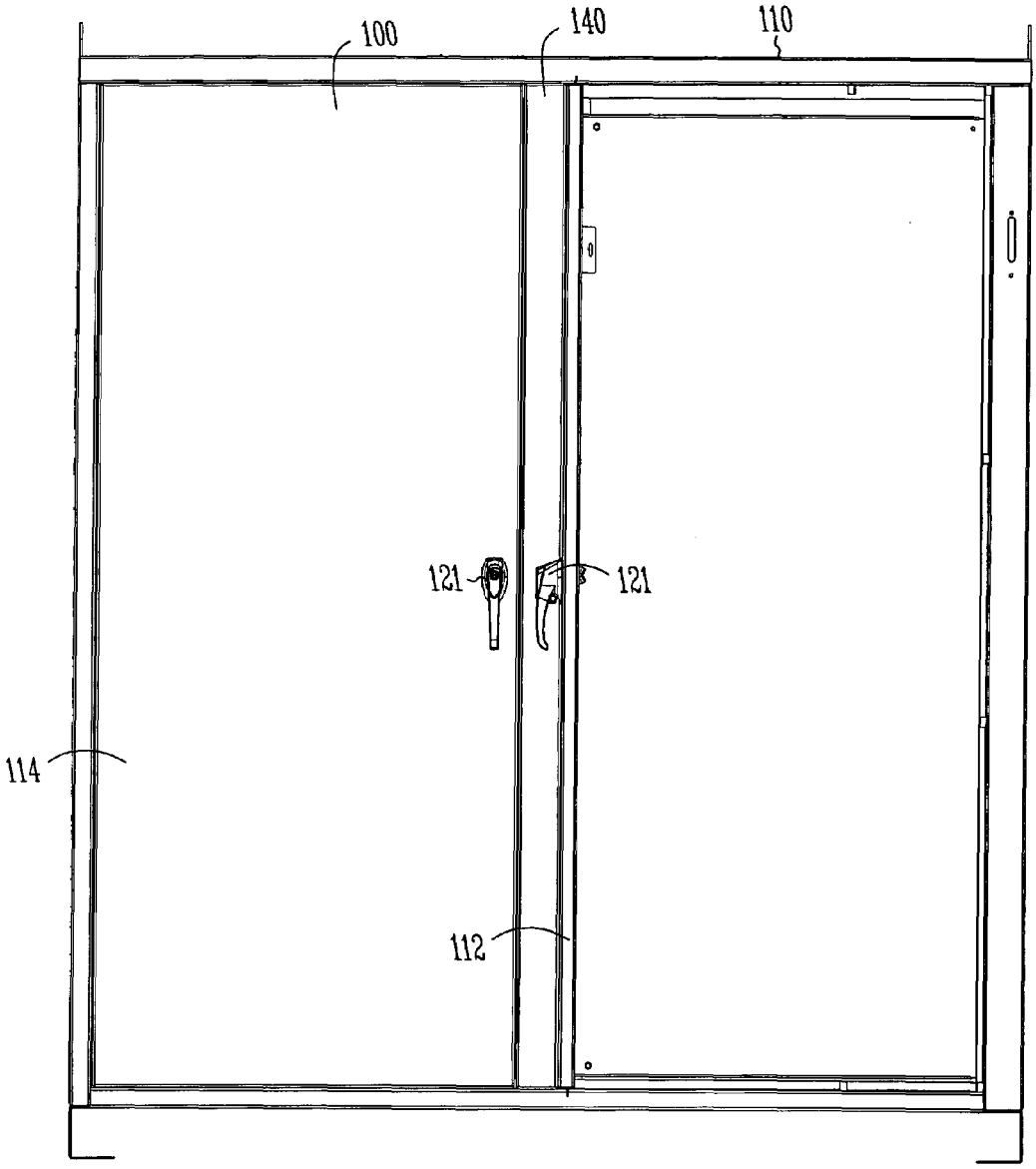
FIG. 2 shows a front view of the enclosure of FIG. 1.

FIG. 1 shows a perspective view of a multi-door enclosure 100 according to one embodiment. FIG. 2 shows a front view of enclosure 100. Enclosure 100 includes an enclosure body or housing 110 having a primary door 112 and a secondary door 114. Enclosure 100 is for holding electrical equipment, for example. Doors 112 and 114 are attached to housing 110 by hinges 116 and 118, respectively. Each door 112 and 114 includes a conventional door latching assembly 120. By turning a handle 121 a latch engages a side flange of housing 110 and a pair of vertically translating members 126 and 128 translate to engage the top and bottom portions, respectively, of housing 110.

Enclosure 100 also includes a door post 140 between primary door 112 and secondary door 114 and extending from the bottom to the top of the enclosure housing. In this example, primary door 112 is hinge mounted to the door post, and door 114 is hinge mounted to a side of the enclosure. Accordingly, the hinged side of the primary door is adjacent the non-hinged side of the secondary door.

Enclosure 100 is designed such that secondary door 114 cannot be opened unless primary door 112 is open. In other words, if primary door 112 is closed, secondary door 114 will be unopenable. As will be detailed below, enclosure 100 includes an interlock assembly which is configured to prevent secondary door 114 from being opened unless primary door 112 is opened first.

Figure 3:
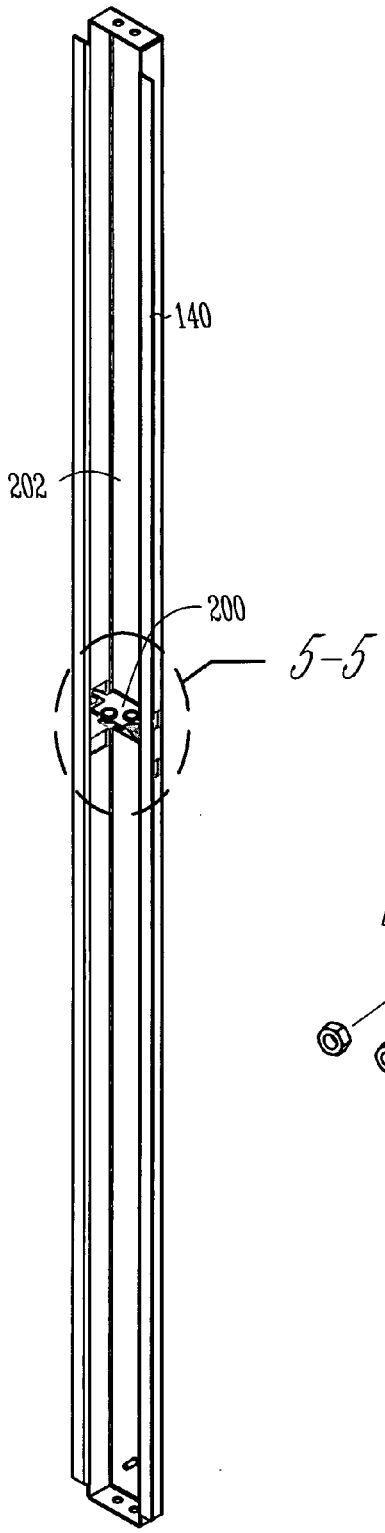
FIG. 3 shows a rear perspective view of an interlock assembly mounted to a door post, in accordance with one embodiment.

FIG. 3 shows a rear perspective view of an interlock assembly 200 mounted to back surface 202 of door post 140. The primary and secondary doors are not shown for sake of clarity. In this view the primary door would be on the left of the view and hinged to door post 140 and the secondary door would be on the right side of the view with its non-hinged side abutting the door post. Interlock assembly 200 is configured such that when the primary door is closed, the interlock assembly latches the secondary door as long as the primary door is closed. Further, interlock assembly 200 is configured to allow the secondary door to close (and latch) even if the primary door is already closed. Interlock assembly 200 extends horizontally across door post 140 between the primary door and the secondary door and is slidably coupled to an inner surface of door post 140. As the primary door closes, an edge of the hinged side of the door contacts one end of interlock assembly to translate the interlock assembly horizontally towards the secondary door until a section of the interlock assembly latches or engages the secondary door. This prevents the secondary door from being opened.

Figure 4:
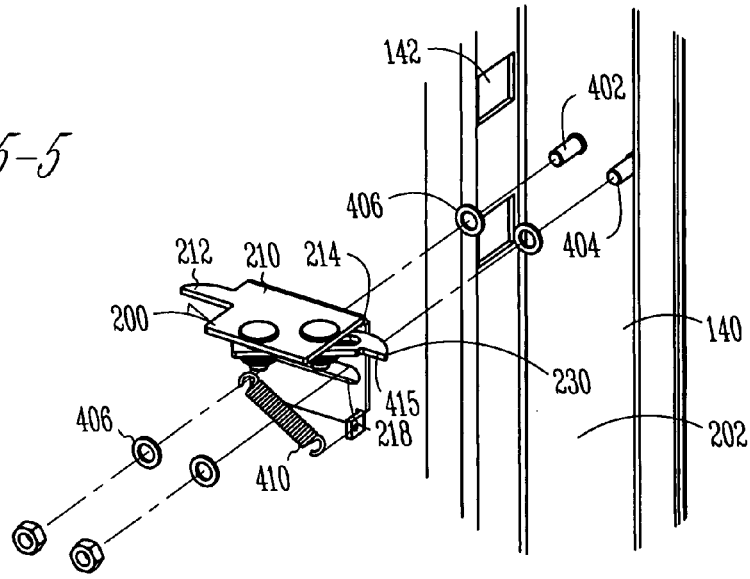
FIG. 4 shows an exploded view of the interlock assembly of FIG. 3.
Figure 5:
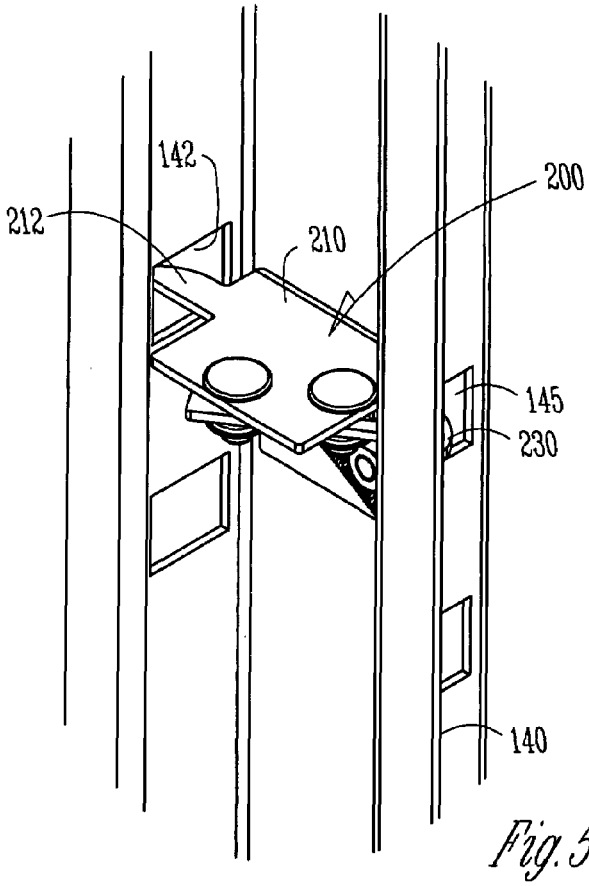
FIG. 5 shows a rear perspective view of the interlock assembly of FIG. 3.
Figure 6:
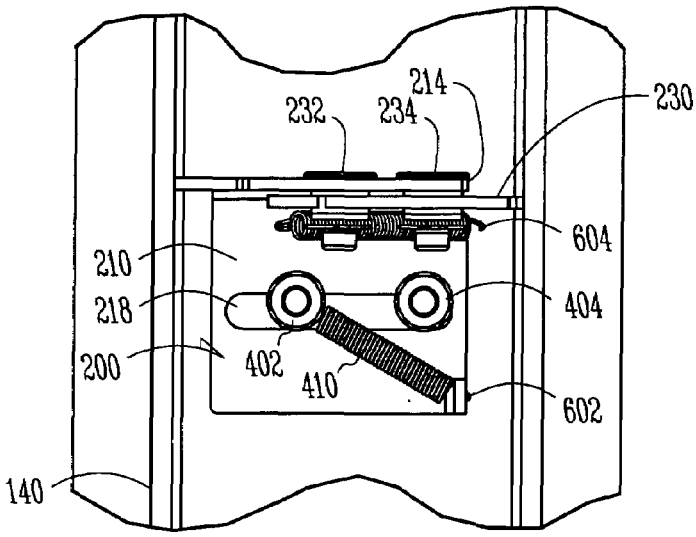
FIG. 6 shows a back view of the interlock assembly of FIG. 3.

FIGS. 4-6 show further details of interlock assembly 200, according to one embodiment. FIG. 4 shows an exploded view of interlock assembly 200, FIG. 5 shows a rear perspective view of the interlock assembly, and FIG. 6 shows a back view of the interlock assembly. In one embodiment, interlock assembly 200 generally includes an actuating member 210 slidably mountable to the enclosure between the primary door and the secondary door. Actuating member 210 includes a first end 212 extendable through an opening 142 in door post 140. A latching member 230 is slidably mounted to actuating member 210 and extends over a second end 214 of the actuating member. A second hole or opening 145 in the opposite side of door post 140 from opening 142 allows a holding section 415 of latching member 230 to go through opening 145 and engage the secondary door.

Actuating member 210 is mounted to door post 140 by one or more fasteners 402 and 404. A slot 218 in member 210 receives fasteners 402 and 404 and allows the interlock assembly to translate horizontal between the primary door and the secondary door. Fasteners 402 and 404 mount actuating member 210 to the housing such that the actuating member slides freely back and forth relative to housing 110 via slot 218. In one embodiment, one or more nylon washers 406 can be provided to decrease friction. Thus actuating member 210 moves from a first position where first end 212 extends through opening 142 of door post 140 when the primary door is open to a second position where first end 212 is on the inside of opening 142 when the primary door is closed. This action translates the interlock assembly 200 towards the secondary door and holding section 415 of latch member 230 then extends through opening 145.

Latching member 230 is slidably mounted to the actuating member by posts 232 and 234. As will be discussed below, a slot in the latching member allows it to translate relative to the actuating member.

Actuating member 210 and latching member 230 can both be rigid members formed of steel or aluminum, for example.

In one embodiment, a biasing member, such as a spring 410, is mounted between actuating member 210 and the enclosure to provide a force to bias the actuating member 210 back towards the primary door to automatically unlatch the secondary door when the primary door is opened. For example, spring 410 can be mounted between fastener 402 and a mounting section 602 of member 210. As the primary door is closed, the edge of the primary door contacts end 212 to move interlock assembly 200 towards the secondary door, where latching member 230 then engages the secondary door. Again, when the primary door is opened, spring 410 forces or biases the assembly 200 back towards the primary door and holding section 415 moves through opening 145 and the secondary door is unlatched.

In one embodiment, a biasing member, such as a spring 604, is attached between the latching member 230 and the actuating member 210. This is used when the primary door has been closed, but the secondary door is still open. As a user closes the secondary door, an edge of the secondary door contacts the end of the latching member and causes it to translate towards the primary door. An opening or cut-out, or other latching mechanism in the secondary door (for example, the secondary door can include an opening corresponding to opening 145 on an edge surface of the door adjacent to door post 140) then is latched to holding section 415 of the latching member and the latching member springs back into its latched position extending through opening 145.

Figure 8:
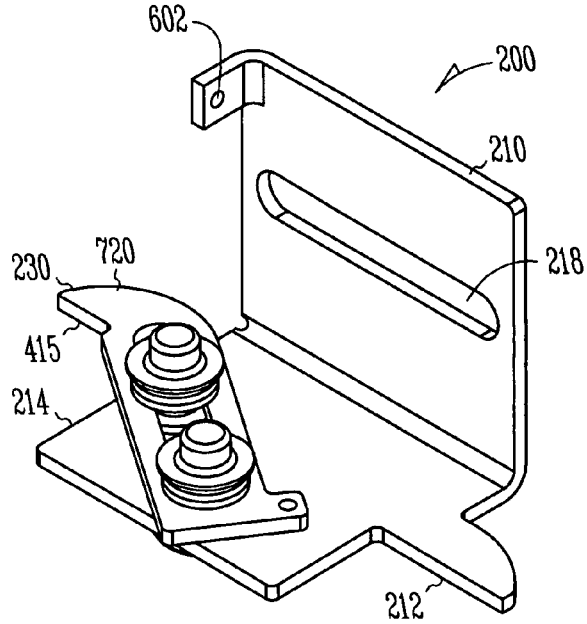
FIG. 8 shows a bottom perspective view of the interlock assembly of FIG. 7.
Figure 7:
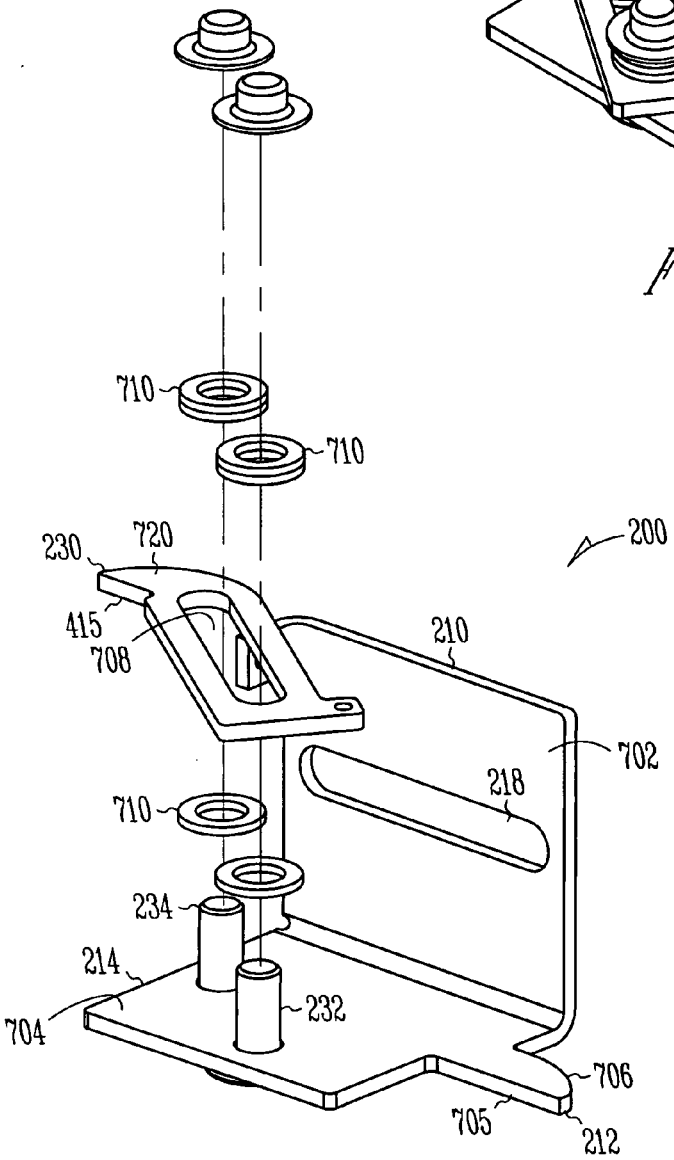
FIG. 7 shows an exploded, bottom perspective view of an interlock assembly according to one embodiment.

Further details of interlock assembly 200 are shown in FIGS. 7-8. FIG. 7 shows an exploded, bottom perspective view of interlock assembly 200 while FIG. 8 shows a bottom perspective view of the interlock assembly.

Actuating member 210 includes a first wall 702 for mounting the actuating member to the enclosure and a second wall 704 substantially perpendicular to the first wall. Latching member 230 is mounted to second wall 704 and lies in the same plane as the second wall. Second wall 704 of the actuating member includes a lip 705 on end 212 of the second wall. In one example, lip 705 includes a curved surface 706 to provide a cam surface as the primary door closes. Thus the edge of the primary door smoothly engages the cam surface to translate interlock assembly 200 towards the secondary door.

Latching member 210 includes a slot 708 and is mounted at angle to the actuating member via fasteners 232, 234. Washers 710 can be used to reduce friction. In one embodiment, the angle between the two members can be about 45 degrees. Latching member includes a curved surface 720 facing the front of the enclosure. Again, this allows a smooth translating action as the secondary door is closed since as the secondary door is closed an edge of the door contacts the curved surface and translates the latching member relative to actuating member 210.

The interlock system discussed above provides a technique of interlocking a multi-door enclosure. In one example use, the assembly is mounted to a door post as described above. As a user closes the primary door, the actuating member is contacted by an edge of the door and translated towards the second door, where the latching member engages a portion of the secondary door. Moreover, the interlock assembly is configured to allow the secondary door to be closed and latched even if the primary door is closed first.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An apparatus comprising:

an enclosure including a primary door and a secondary door and a door post between the primary door and the secondary door;

an actuating member assembled to be slidably mounted to the door post between the primary door and the secondary door of the enclosure, the actuating member configured to translate towards the secondary door when the primary door is closed;

a latching member slidably mounted to the actuating member, the latching member for latching the secondary door when the primary door is closed, and a biasing member attached between the latching member and the actuating member to bias the latching member outward away from the actuating member.

2. The apparatus of claim 1, wherein the latching member includes a first end extending over an end of the actuating member to latch to the secondary door.

3. The apparatus of claim 1, further including a biasing member attached between the enclosure and the actuating member to bias the actuating member towards the primary door.

4. The apparatus of claim 1, wherein the latching member includes a curved surface facing a front of the enclosure.

5. An apparatus comprising:

an enclosure including a primary door and a secondary door and a door post between the primary door and the secondary door;

an actuating member assembled to be slidably mounted to the door post between the primary door and the secondary door of the enclosure, the actuating member configured to translate towards the secondary door when the primary door is closed; and a latching member slidably mounted to the actuating member, the latching member for latching the secondary door when the primary door is closed, wherein the actuating member includes a lip for contacting an edge of the primary door when the primary door is closing.

6. The apparatus of claim 5, wherein the lip includes a curved surface facing the front of the enclosure.

7. A system comprising:

an enclosure having a primary door and a secondary door, the primary door and secondary door having a door post located therebetween, the door post including a first and a second opening;

an actuating member slidably mountable to the door post, the actuating member having a first end extendable though the first opening and configured to translate towards the secondary door when the primary door is closed; and a latching member slidably mounted to the actuating member and extending over a second end of the actuating member and extending though the second opening, the latching member for latching to the secondary door when the first door is closed to prevent the secondary door from being opened when the primary door is closed.

8. The system of claim 7, wherein the primary door is hinged adjacent the door post.

9. The system of claim 7, wherein the actuating member translates in a horizontal direction between the primary door and the secondary door.

10. The system of claim 7, wherein a biasing member is coupled to the actuating member to bias the actuating member towards the primary door when the primary door is opened.

11. The system of claim 7, wherein the secondary door includes an opening or cut-out to engage the latching member.

* * * * *

UNITED STATES PATENT AND TRADEMARK OFFICE

CERTIFICATE OF CORRECTION

PATENT NO. : 7,275,770 B2
APPLICATION NO. : 11/055538
DATED : October 2, 2007
INVENTOR(S) : Guebre-Tsadik et al.

It is certified that error appears in the above-identified patent and that said Letters Patent is hereby corrected as shown below:

In column 5, line 8, in Claim 7, delete “though” and insert -- through --, therefor.

In column 5, line 13, in Claim 7, delete “though” and insert -- through --, therefor.

Signed and Sealed this

Eleventh Day of December, 2007

JON W. DUDAS
*Director of the United States Patent and Trademark Office*